US005926196A

United States Patent [19]

Sawicki et al.

[11] Patent Number: 5,926,196

[45] Date of Patent: Jul. 20, 1999

[54] STORAGE CONTAINER FOR AN INK JET PRINTHEAD CARTRIDGE

[75] Inventors: Paul F. Sawicki; Karai P. Premnath; William L. King, all of Rochester; Robert J. Tannascoli, Webster; Thomas R. Binnert, Hammondsport, all of N.Y.

[73] Assignee: Xerox Corporation, Stamford, Conn.

[21] Appl. No.: 08/874,622

[22] Filed: Jun. 13, 1997

[51] Int. Cl.[6] ..... B41J 2/165

[52] U.S. Cl. ..... 347/108; 347/29

[58] Field of Search ..... 347/29, 32, 22, 347/85, 86, 87, 108; 206/204; 277/300

[56] References Cited

U.S. PATENT DOCUMENTS

| | | | |
|---|---|---|---|
| Re. 32,572 | 1/1988 | Hawkins et al. | 156/626 |
| 4,638,337 | 1/1987 | Torpey et al. . | |
| 4,774,530 | 9/1988 | Hawkins . | |
| 5,365,645 | 11/1994 | Walker et al. | 29/25.35 |
| 5,373,936 | 12/1994 | Kawai et al. | 206/204 |
| 5,602,573 | 2/1997 | Waschhauser et al. | 347/33 |
| 5,667,063 | 9/1997 | Abe | 347/108 |
| 5,805,181 | 9/1998 | Tanaka et al. | 347/29 |

*Primary Examiner*—N. Le
*Assistant Examiner*—Anh T. N. Vo

[57] ABSTRACT

A storage container for temporarily storing an ink jet printhead cartridge during periods of non-use, the container including an improved nozzle capping mechanism which permits a variable range of forces to be applied to obtain the necessary sealing. The membrane is characterized by having, on one surface, a ribbed section which encircles the nozzle area to form a sealing perimeter. The other surface of the membrane has a shallow recess formed beneath the ribbed section, the recess providing for inward deflection along the ribbed area, the ribbed section maintaining an effective seal throughout a deflectable range. The arrangement solves a prior art problem of membrane buckling when excessive force is applied.

5 Claims, 6 Drawing Sheets

STORAGE CONTAINER FOR AN INK JET PRINTHEAD CARTRIDGE

BACKGROUND OF THE INVENTION AND MATERIAL DISCLOSURE STATEMENT

The present invention relates generally to a thermal ink jet printer used to form images on a recording medium and, more particularly, to a storage container for storing an ink jet printhead cartridge during periods of non-use.

Ink jet printers, or plotters, of the so-called "drop-on-demand" type have at least one printhead from which droplets of ink are directed towards a recording medium. Within the printhead, the ink is contained in a plurality of channels and energy pulses are applied to transducers to cause the droplets of ink to be expelled, as required, from nozzles at the ends of the channels.

In a piezoelectric printer of the type disclose, for example, in U.S. Pat. No. 5,365,645, the transducers are piezoelectricity deflectable plates. In a thermal ink jet printer of the type disclosed, for example, in U.S. Re. 32,572, the transducers are resistors, which are individually addressable by current pulses to heat and vaporize ink in a channel or recess proximate to the nozzle. As a vapor bubble grows, ink bulges from the nozzles until the current pulse has ceased and the bubble begins to collapse. At that stage, the ink within the channel or recess retracts and separates from the bulging ink which forms a droplet moving in a direction away from the nozzles and towards the recording medium. The channel or recess is then re-filled by capillary action, which in turn draws ink from a supply cartridge. Operation of a thermal ink jet printer wherein the ink is expelled from channels is described in, for example, U.S. Pat. Nos. 4,638,337 and 4,774,530, which disclose a printer of the carriage type having a plurality of printheads, each with its own ink supply reservoir, mounted on a reciprocating carriage. The nozzles of each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It is necessary to periodically store an ink jet printhead cartridge in a humid environment during periods of non-use. The storage medium most typically includes a capping mechanism for sealing the printhead nozzle face to obtain an airtight seal for the nozzles to inhibit evaporation of ink within the ink channels. U.S. Pat. No. 5,373,936 discloses a storage container which includes a pumping mechanism for applying negative pressure to remove ink from around the ink nozzles while applying a capping mechanism in sealing engagement with the nozzle face.

A continuing problem with prior art capping mechanisms is the tendency of the sealing edges of the nozzle face capping mechanism interface to buckle and allow exposure to the external environment (also called seal loss) because of the applied sealing force.

The problem is shown with reference to FIG. 1, which shows in schematic form a portion of a prior art storage container 8, which incorporates a ribbed, low durometer (20±5 shore "A") capping membrane 10 typically made of a material such as silicone. A printhead cartridge 12 includes an ink tank 14 filled with ink 15 fluidly connected to a printhead 16 having a plurality of channels terminating at nozzles in a nozzle face 18. Capping membrane 10 includes a raised rib portion 11 which assumes a generally rectangular orientation with an area which encompasses the nozzles of nozzle face 18. Member 10 also has a base portion 13. The cartridge 12 must be seated within a container such that the nozzle face 18 is in sealing contact against base 13 with ribbed portion 11 providing the edge seal. The cartridge 12 is moved so as to create a force great enough to effectively seal nozzle face 18 but not so strong as to cause buckling in rib portion 11. This buckling tends to occur as the compression load increases and the rib section can no longer withstand the compression. This buckling tends to occur over long sections, but not at the corners where the strength is greater.

The applied sealing force is large enough to compensate for non-planarity of the nozzle face surface. The design latitude for such a prior art sealing mechanism is typically quite narrow and requires a relatively large sealing force to be applied.

Another problem with the prior art design of FIG. 1 is that when the nozzle face is seated, an air pocket can be compressed creating a positive pressure buildup around the nozzle face which can exceed 1 psi. At this pressure, the printhead begins to deprime with ink being forced back into the ink channels. Also, while the printhead remains capped, temperature changes can also increase the positive pressure. When the printhead is removed, the release of the positive pressure can result in ink weeping from the nozzles.

SUMMARY OF THE INVENTION

It is, therefore, an object of the present invention to provide a storage container for a printhead cartridge which provides a humid environment in which the nozzle face of the printhead is effectively sealed and available for reinsertion into a printing system.

It is a further object to place the printhead nozzle face into sealing engagement with a capping member such that a wide design latitude is available for applying the sealing force to the printhead nozzle face.

It is another object of the invention to effect a nozzle face sealing to a capping mechanism in a storage container such that increases in positive pressure against the nozzle is avoided.

It is a still further object to provide a storage container which requires a relatively low sealing force to be applied to the stored cartridge.

It is another object to provide a sealing member which compensates for non-planarity in the nozzle face of the stored printhead.

These, and other objects, are accomplished by providing a storage container which includes a capping membrane having a voided area beneath a ribbed sealing section. This design weakens the ribbed section so that when a sealing force is applied to bring the printhead nozzle face against the ribbed portion of the capping membrane, the sealing rib pivots inward (downward) to maintain the desired seal. The prior art buckling phenomena is thus eliminated.

In another embodiment, the capping membrane has a capillary channel formed on a surface which provides for venting of air from the sealing area thus preventing buildup of positive air pressure.

More particularly, the present invention relates to a storage container for storing at least one ink jet cartridge, the cartridge including an ink jet printhead having a nozzle array at a nozzle face, the nozzles fluidly connected to an ink reservoir, the container comprising:

a lower section for seating said at least one ink jet cartridge, an upper pivotable cover section, the lower section characterized by having located on an internal wall a nozzle capping membrane which includes a raised rib section on one surface defining an area larger than said nozzle array and a recess section formed on the surface of said membrane opposite said ribbed section whereby when the cover section is pivoted to close the container, a force is applied to the stored cartridge which brings the nozzle array into intimate contact with said membrane, the membrane being deflectable inward by said recess section to enable effective sealing over a range of force values.

DESCRIPTION OF THE INVENTION

Figure 1:
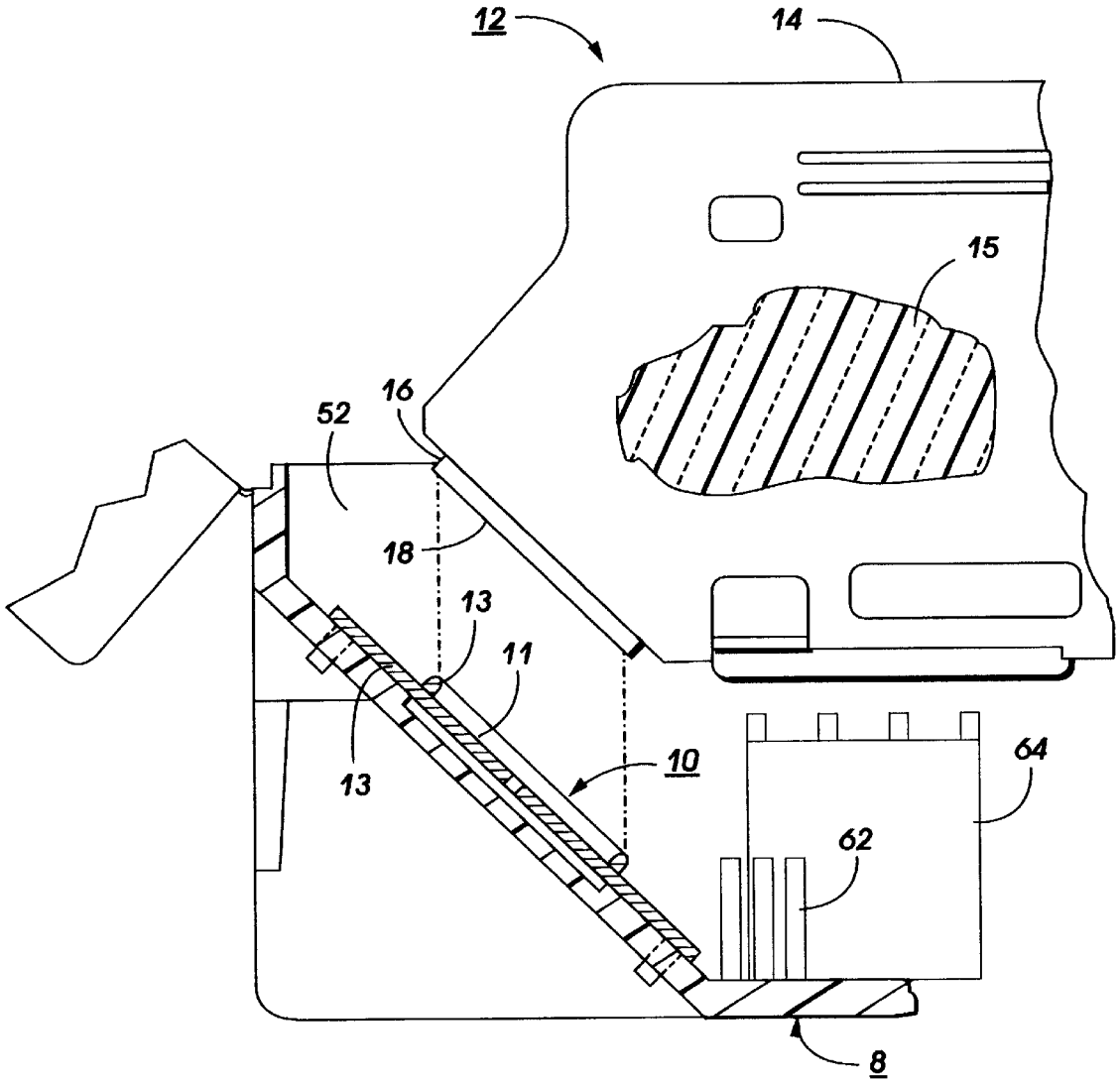
FIG. 1 PRIOR ART
FIG. 1 is a partial schematic view of a prior art printhead cartridge storage container.
Figure 2:
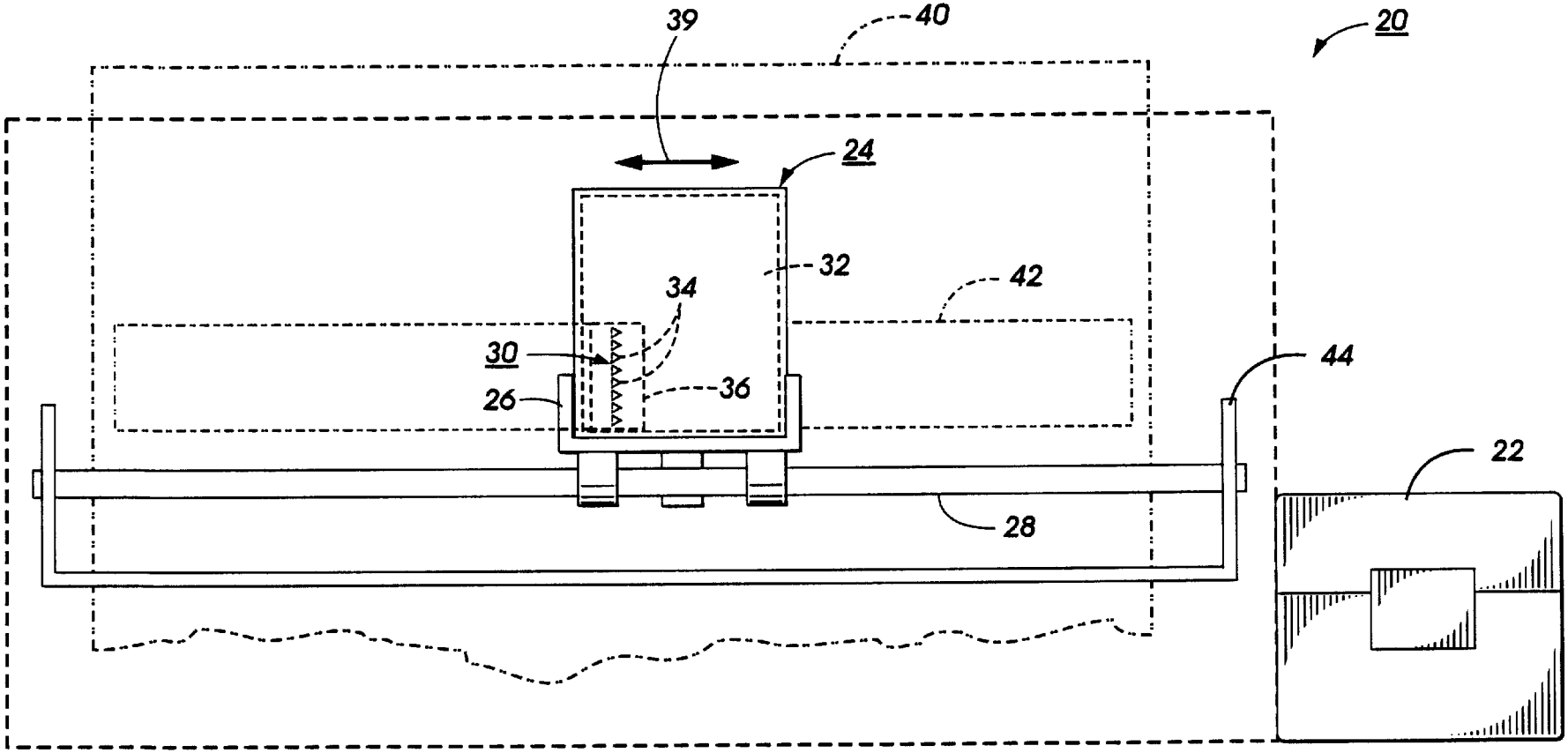
FIG. 2 is a schematic view of an ink jet printing system incorporating a thermal ink jet printhead cartridge and including a storage container according to the invention for temporary storage of the printhead cartridge during periods of non-use.

FIG. 2 is a partial view of an ink jet printer 20 which incorporates a printhead storage container 22 of the present invention. The printer 20, in an exemplary embodiment, is the Xerox Personal Printer 4004 which includes a printhead cartridge 24 mounted on a scanning carriage 26, translatable back and forth on guide rails 28. Cartridge 24 comprises a printhead 30 and an integral ink supply reservoir 32, which is filled with ink or with an ink impregnated foam material. Formed within the printhead are a plurality of ink channels, each with a resistive heater, the channels continuously supplied with ink from the reservoir through a printhead fill hole. The ink channels terminate in nozzles 34 in nozzle face 36. In use, the scanning carriage 26 reciprocates, in the direction of arrow 39, and resistor heaters are selectively energized causing droplets of ink to be expelled through associated printhead nozzles. The droplets are directed towards the recording medium 40 along a printing zone or swath 42. During each pass of the scanning carriage, the recording medium is stationary. At the end of each pass, the recording medium 40 is stepped up to the next print line. Further details of operation of this type of printing system are found in U.S. Pat. Nos. 4,638,337 and Re. 32,572, whose contents are hereby incorporated by reference.

Depending upon a particular print operation, it may be necessary to remove cartridge 24 and replace it with another cartridge which prints, for example, a different color ink or ink of a different density. It is assumed that cartridge 24 has sufficient ink capacity for later re-use. According to the invention, a storage container 22 is attached to frame 44 of the printer. Container 22 may be permanently attached in which case the cartridge is easily stored and retrievable, or the container may be detachably mounted so that the container and the cartridge can be stored at a remote location.

Figure 3:
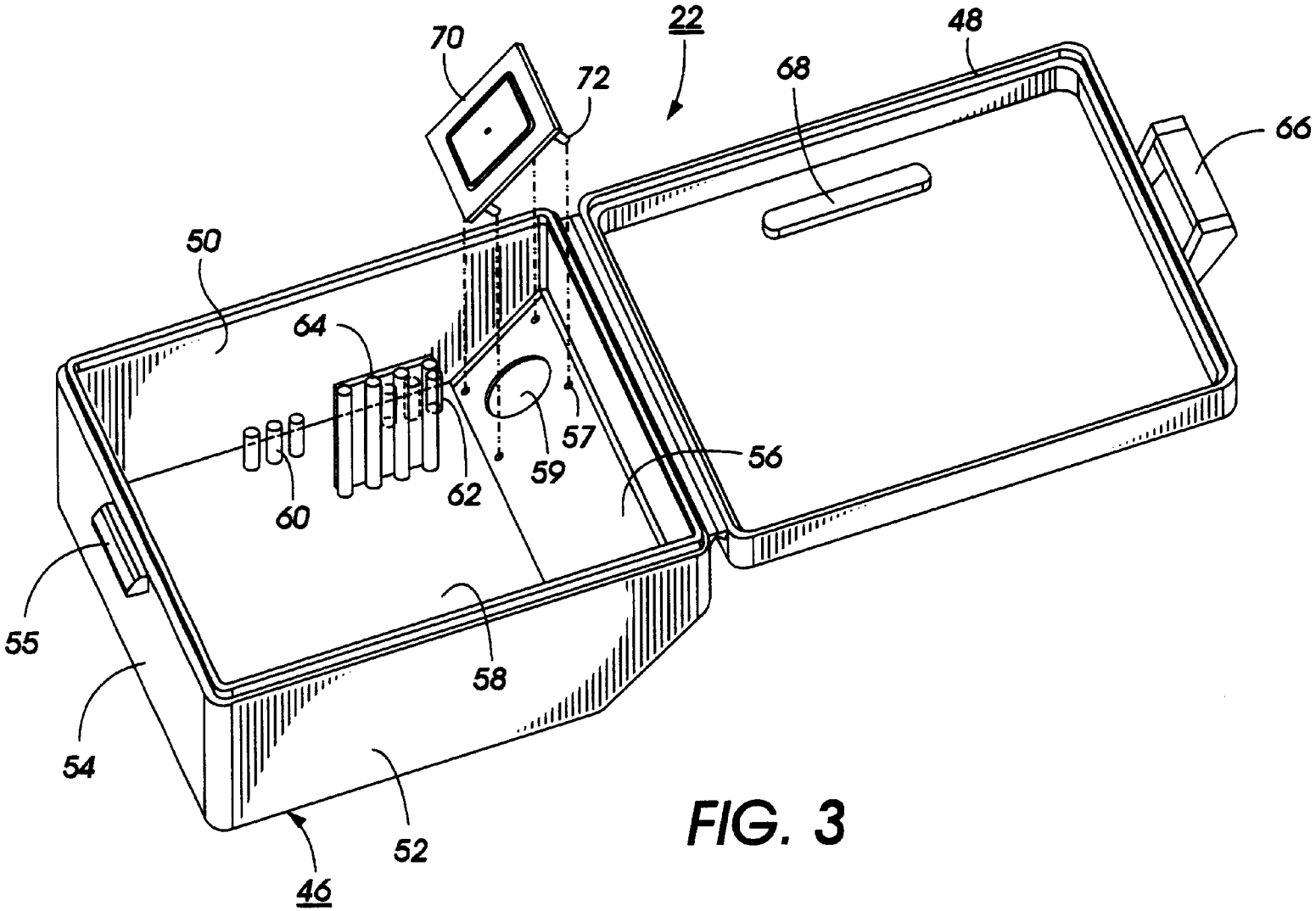
FIG. 3 is a perspective view of the storage container of FIG. 2 in an open position.

Storage container 22 is shown in a top perspective view in FIG. 3. Container 22 consists of a lower housing portion 46 and a hinged cover 48. Lower housing section includes two parallel vertical side walls 50, 52, a vertical front wall 54 with molded catch 55, an angled rear wall 56, and a floor 58. Four holes 57 are formed in wall 56 with a shallow elliptical recess 59 formed therebetween for purposes to be described later. Floor 58 includes raised series of seating columns 60, 62, 64 which, it will be seen, cooperate with apertures in cartridge 24 to create a secure seating position. Cover 48 includes a clasp 66 and a foam hold-down member 68. Member 68 can be a micro-cellular urethane.

Figure 4A:
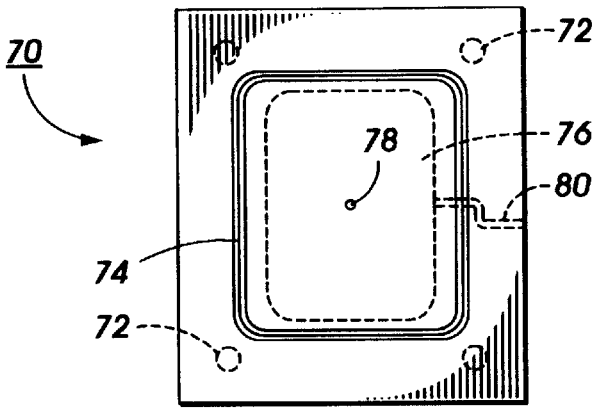
FIG. 4A is a top perspective view of the capping membrane located on an angled wail of the storage container.
Figure 4B:
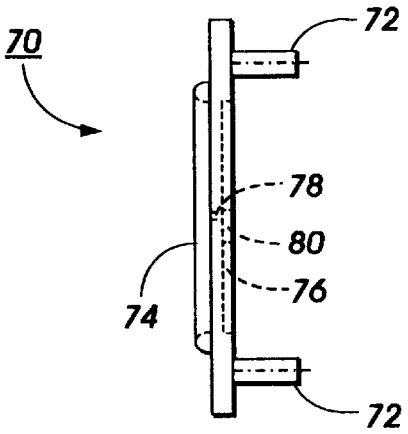
FIG. 4B is a side view of the capping member.
Figure 4C:
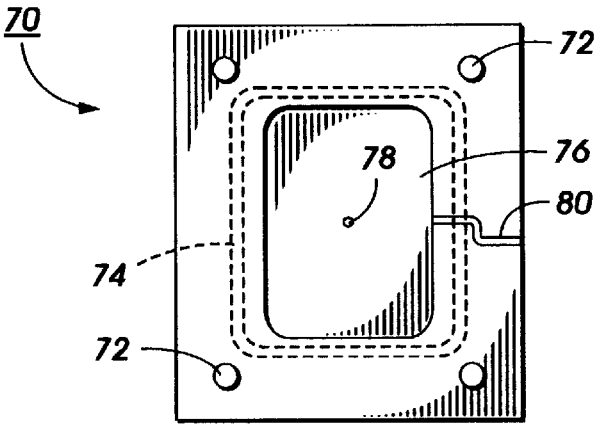
FIG. 4C is a bottom view of the capping member.

A capping member 70, shown in exploded view, is made of an integrally molded silicone material. In a preferred embodiment, the membrane has four legs 72 which snugly fit into holes 57 to provide a firm attachment of membrane 70 against the surface of wall 56. Further description of membrane 70 is with reference to top perspective view of FIG. 4A, side view of FIG. 4B, and bottom perspective view of FIG. 4C. Membrane 70 has, on the top surface, a generally rectangular, raised rib section 74 and, on the bottom surface, a shallow, generally rectangular recess section 76 slightly larger than section 74. An aperture 78 is formed through the center of the membrane connecting both sections. A capillary channel 80 is formed on the bottom surface providing an air vent between section 76 and the interior of the box as will be seen.

Figure 5:
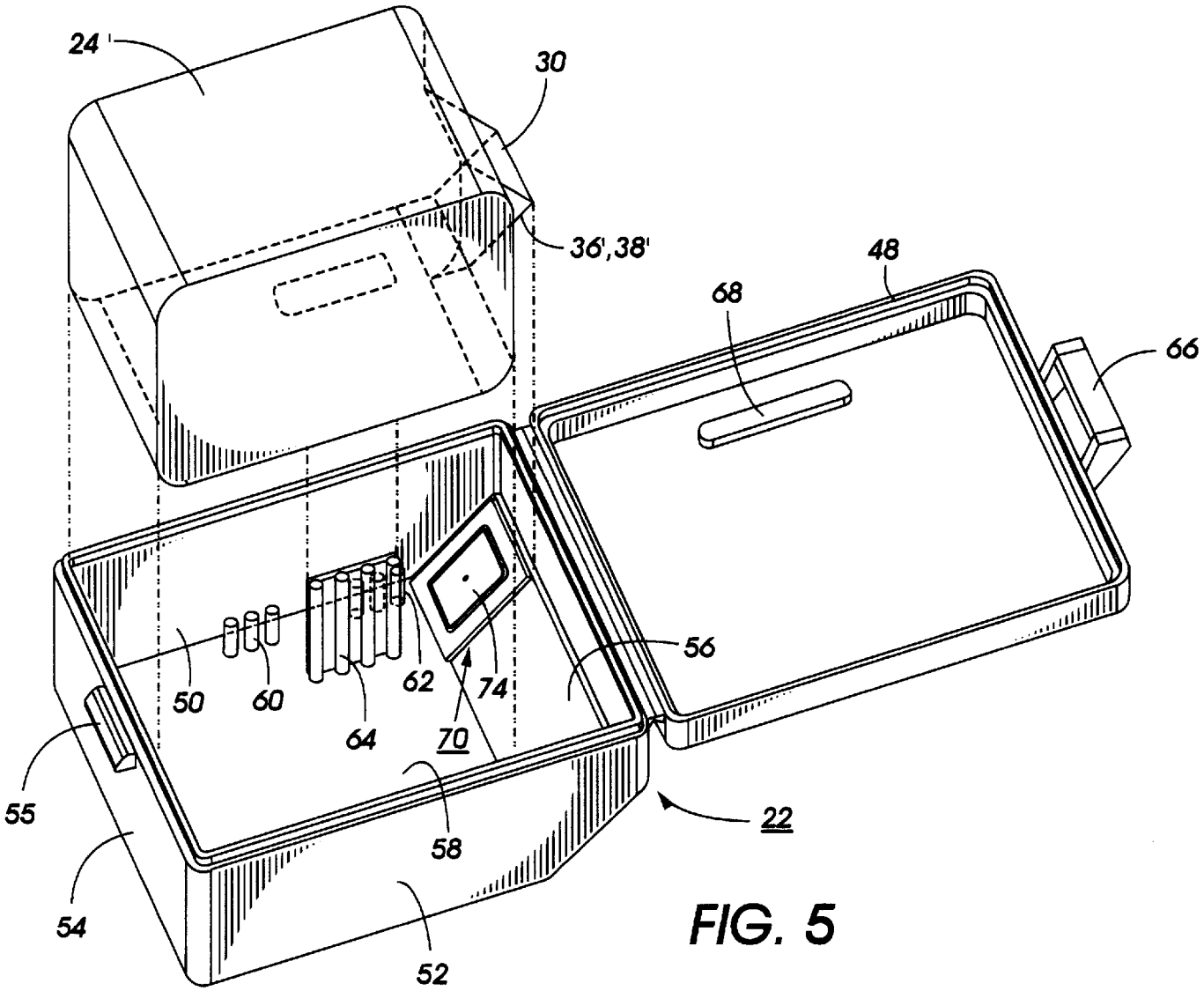
FIG. 5 is an exploded view of a printhead cartridge stored in the storage container.
Figure 6:
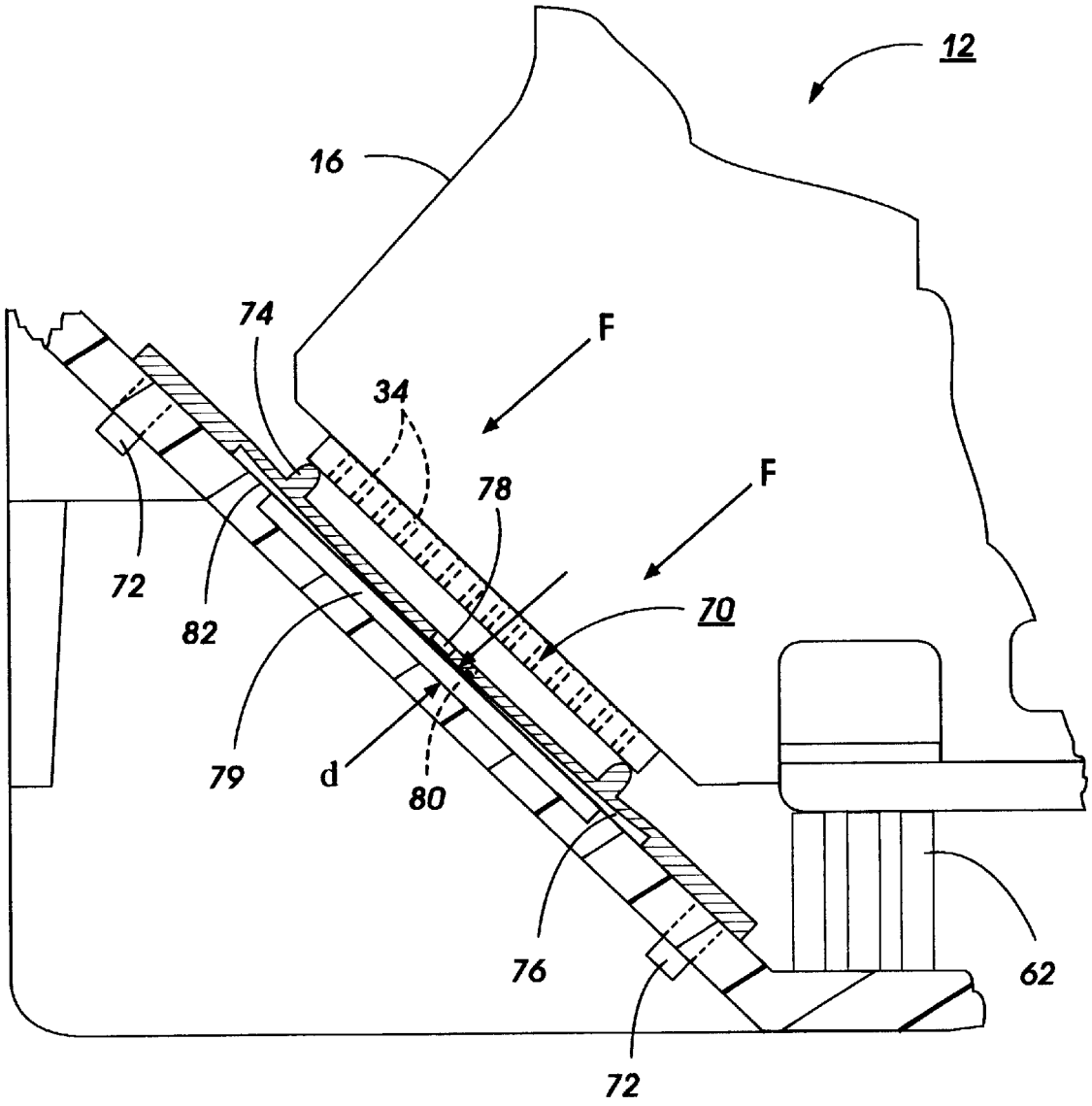
FIG. 6 shows details of the sealing of the printhead nozzle face to the capping member.

FIG. 5 shows an exploded view of a printhead cartridge 24' seated for temporary storage in container 22. FIG. 6 shows an enlarged view of the nozzle face 36' of printhead 30 sealed in position against capping membrane 70. Referring to FIG. 5, cartridge 24', for descriptive purposes, is a black only cartridge used in the Xerox Personal Printer 4004. The cartridge has three apertures (not visible) which enable seating onto columns 60, 62, 64. Referring to FIG. 6, nozzle face 36' has a single row of nozzles 34 which are brought into contact with the center of ribbed section 74. The raised rib portion are brought into intimate contact with the surface of nozzle face 36 to provide the seal around the nozzles. When cartridge 24 is seated, cover 48 (FIG. 3) is pivoted and closes the container by clasp 66 engaging catch 55. A predetermined force F, with a relatively wide degree of latitude, is brought to bear on the cartridge, localized at foam member 68 and at, or near, the center of gravity of the cartridge, to provide a sealing engagement force.

As the nozzle face is forced against the surface of membrane 70, the recess section 76 permits a slight degree of inward (downward) deflection, or inward pivoting, represented by a distance d which can be as large as the depth of recess 76 (typically 0.25 mm) and may even intrude into recess 59 formed in wall 56. This feature allows the ribbed section 74 to maintain an effective sealing across the nozzles with a lower sealing force being applied. As the nozzle face is forced into sealing engagement, air is forced out through aperture 78 and through the capillary channel 80 at an interface location 82 thereby preventing positive air pressure build up.

In an exemplary embodiment, member 70 is a molded silicone, ribbed section 74 has a height of 1 mm, recess 76 has a depth of 0.25 mm, and elliptical recess 59 has a depth of 0.50 mm. Storage container 22 is an integrally molded polypropylene, and force F is 800±200 grams.

It is understood that other types of ink jet printhead cartridges could be stored in the storage container of the present invention including cartridges with multiple printheads with each printhead nozzle face being sealed against a separate capping membrane.

While the embodiment disclosed herein is preferred, it will be appreciated from this teaching that various alternative, modifications, variations or improvements therein may be made by those skilled in the art, which are intended to be encompassed by the following claims:

We claim:

1. A storage container for storing at least one ink jet cartridge, the cartridge including an ink jet printhead having a nozzle array at a nozzle face, a plurality of nozzles in the nozzle array fluidly connected to an ink reservoir, the container comprising:

a lower section for seating said at least one ink jet cartridge, an upper pivotable cover section, the lower section characterized by having located on an internal wall a nozzle capping membrane which includes a raised rib section on one surface defining an area larger than said nozzle array and a recess section formed on a surface of said membrane opposite said ribbed section whereby, the nozzle array is brought into intimate contact with said raised rib section of the membrane to provide a seal, the membrane being deflectable inward into said recess section to enable effective sealing.

2. The container of claim 1 wherein said membrane has a capillary channel formed on one surface thereof to enable venting of air during application of the sealing force.

3. The container of claim 1 wherein said lower section has a floor with a plurality of vertical columns which cooperate with apertures in said cartridge to provide a stable seating of said cartridge within said container.

4. The container of claim 3 wherein said internal wall at an angle to said floor.

5. The container of claim 1 wherein said cover includes a foam member affixed to an interior surface contacts the top of said seated cartridge.

* * * * *